United States Patent [19]

Fikse

[11] Patent Number: 4,915,453

[45] Date of Patent: Apr. 10, 1990

[54] FLOATING SHOE TUNNEL BORING MACHINE AND BORING PROCESS

[76] Inventor: Tyman H. Fikse, P.O. Box, LaConner, Wash. 98257

[21] Appl. No.: 183,020

[22] Filed: Apr. 18, 1988

[51] Int. Cl.[4] ..... F21C 29/02; F21D 9/08

[52] U.S. Cl. ..... 299/31; 299/33; 405/138; 405/142

[58] Field of Search ..... 299/10, 31, 33, 55, 299/56, 58; 405/142, 141, 138; 175/61, 62

[56] References Cited

U.S. PATENT DOCUMENTS

| | | | |
|---|---|---|---|
| Re. 31,511 | 1/1984 | Spencer | 299/56 |
| 3,203,737 | 8/1965 | Robbins et al. | 299/31 |
| 3,295,892 | 1/1967 | Winberg et al. | 299/31 |
| 3,861,748 | 1/1975 | Cass | 299/10 |
| 3,967,463 | 7/1976 | Grandori | 405/141 |
| 4,420,188 | 12/1983 | Robbins et al. | 299/31 |
| 4,548,443 | 10/1985 | Turner | 299/31 |

FOREIGN PATENT DOCUMENTS

| | | | |
|---|---|---|---|
| 95795 | 12/1983 | European Pat. Off. | 405/142 |
| 2252308 | 7/1973 | Fed. Rep. of Germany | 299/31 |

*Primary Examiner*—Stephen J. Novosad
*Assistant Examiner*—David J. Bagnell
*Attorney, Agent, or Firm*—Robert W. Beach; Ward Brown

[57] ABSTRACT

A tunneling machine body carrying a rotary cutterhead can be advanced continuously by exerting advancing thrust forces on it, first by top and bottom bipods reacting from top and bottom anchor shoes, respectively, in anchored condition against the tunnel wall and alternately by side bipods exerting advancing force on the tunneling machine body and reacting from side anchor shoes set in anchored condition against the tunnel wall. The anchor shoes are floating relative to the tunneling machine body and connected to it only by the bipods producing the thrust for advancing the tunneling machine body. The top and bottom anchor shoes are directly connected by two pairs of upright fluid-pressure shoe-setting jacks extending chordwise between such shoes. The side anchor shoes are directly connected by two pairs of transverse fluid-pressure shoe-setting jacks extending chordwise between such shoes. The two pairs of upright anchor-setting jacks are located close together longitudinally of the tunnel boring machine and between the two pairs of transverse jacks. A conveyor for removing muck from a location adjacent to the tunnel face extends rearwardly through the tunneling machine body and between the pairs of the upright and transverse anchor shoe-setting jack pairs.

20 Claims, 7 Drawing Sheets

FLOATING SHOE TUNNEL BORING MACHINE AND BORING PROCESS

BACKGROUND OF THE INVENTION

1. Field of the Invention

This invention relates to a floating shoe shuffling tunnel boring machine having orthogonal anchoring shoe pairs floating relative to the machine body and cutterhead which shoe pairs are set against the tunnel wall in alternating sequence.

Many types of tunnel boring machines have been patented and/or produced which are generally characterized by having a cutterhead carried by and rotatable relative to the machine body to pulverize or comminute rock at the face of a tunnel. The muck is conveyed longitudinally through the boring machine for removal from the tunnel. Representative examples of patents on tunnel boring machines are discussed below.

2. The Problem

Tunnel boring machines are expensive so that it is desirable to provide a tunnel boring machine which will accomplish the tunnel boring operation as quickly as possible. The boring speed can be increased if the cutterhead is advanced continuously against the tunnel face at maximum cutting speed. The cutting speed will be limited by the effectiveness of the cutting operation of the cutterhead and by the material of the tunnel face which is being cut, but whatever the limitation may be on the cutting speed, operating the cutterhead so that it will be cutting continuously will greatly reduce the tunneling time required over the time spent by utilization of a boring machine the cutterhead of which cuts intermittently.

3. Prior Art

The Robbins et al. U.S. Pat. No. 3,203,737, issued Aug. 31, 1965, states at column 4, beginning at line 1:

> Now proceeding to describe said gripper shoes, which function to support the machine during boring operations and are designated by 27, the same are opposingly mounted one at each of the two sides of the machine adjacent the mid-length of the latter. Extending laterally of the machine between these two shoes is the gripper mounting assembly, generally designated by 28. This assembly comprises three basic parts, namely, two open-center cross-heads 30, each of which carries a respective one of the two gripper shoes 27, and a muff 31 producing slideways in each of its two ends for a respective one of the two cross-heads. This mounting assembly has two significant functioning characteristics: (1) the cross-heads can be forced outwardly from one another within the muff by pressure exerted from a set of four large hydraulic gripper jacks 32, which responsively presses the gripper shoes 27 firmly against the tunnel side wall, and (2), with the gripper shoes thus firmly planted, the muff 31 can be shifted laterally, sliding on such localized cross-heads, by means of a set of two smaller hydraulic steering jacks 33. This lateral shifting provides transverse steering for the machine.

The description continues at column 4, line 60:

> When the gripper shoes 27 are in retracted position (i.e. withdrawn from the side wall of the tunnel), the machine is supported by the three steering shoes 20-21-21 at the front of the machine, and by the rear foot 26. To move the gripper shoes 27 forwardly to a gripping position from which the machine can be advanced, and assuming that said shoes have been retracted from the wall, the four thrust jacks 37 are retracted so as to draw the gripper mounting assembly 28 and the carriage 34 forward on the machine frame. The slide mounting therefor is provided by the jumbo bars 36A and 36B. When the gripper shoes 27 have reached their forward limit of travel, the gripper jacks are extended to plant the gripper shoes firmly against the two lateral surfaces of the tunnel side wall.

After the shoes are thus reset, the interrupted boring operation then continues as stated at column 5, beginning at line 24:

> When the machine frame has been properly located and it is desired to then proceed with the boring of the tunnel, straight-line boring is performed by extending the four thrust jacks 37 at equal rates, the thrust jacks pushing against the anchored gripper shoes 27 and responsively forcing the cutting head forwardly in the tunnel.

The resistance to the boring operation is effected only by the gripper shoes 27, as stated at column 5, beginning at line 42:

> The front shoes 20-21-21 co-operate with the gripper shoes 27 in supporting the machine. While the machine is performing its boring function, these shoes 20-21-21 have only sliding contact with the tunnel wall, bearing against the wall only in the degree necessary to stabilize the rotary head.

This machine, therefore, has an intermittent boring operation performed only while the gripper shoes 27 are set against the tunnel wall.

The later Winberg et al. U.S. Pat. No. 3,295,892, issued Jan. 3, 1967, discusses the Robbins et al. U.S. Pat. No. 3,203,737 at column 1, lines 28 to 45. The Winberg et al. patent machine is stated to have been designed for tunnels of say seven feet diameter, whereas the machine of the above Robbins et al. patent is stated to have been designed to bore quite large tunnels, for example sixteen feet in diameter. The Winberg et al. patent, like the Robbins et al. patent, is assigned to James S. Robbins and Associates, Inc.

Diametrically opposite anchoring shoes 42 of the Winberg et al. patent shown in FIGS. 3 and 4 are described at column 3, beginning at line 11:

> The wall-engaging outer faces of the anchoring shoes 42 are generally rectangular in plan configuration, and have projecting spikes 43 for augmenting the wall purchase. When viewed from an end said outer faces are convex to conform to the curvature of the tunnel wall . . .

The muck cut from the tunnel face is removed by the endless conveyor 26 shown in FIG. 1 as being inclined upward over the jack mechanism projecting the anchor shoes 42 oppositely, as described in column 2, lines 32 to 39.

The boring operation is described beginning at column 5, line 28, as follows:

> When the anchor shoes 42 have been retracted from the tunnel wall incident, say, to moving the shoes forward for taking a grip at a new location, the machine is supported by the front-end guide shoes 34 and by a rear foot 100. This rear foot is operated by a hydraulic jack and during working periods of the machine is kept retracted. For said forward movement of the shoes (the present machine being engineered for a 2-foot stroke) the four thrust jacks 81 are retracted. This draws the disengaged shoes ahead, causing the steering box to slide upon the trunk in concert with such advance. Upon reaching the forward limit of this resetting "step," the operator charges pressure fluid into the cylinders 57 of the carriage 41, forcing the pistons outwardly within said cylinders to cause the anchor shoes to be again firmly planted against the tunnel wall.

The description continues at column 5, line 74:

All thrust forces are passed through the jacks 81 from the main body directly to the anchor shoes. With this machine also, a boring operation can be accomplished only when the anchor shoes 42 are planted against the tunnel wall so that the boring operation must be interrupted while the anchor shoes are retracted from the tunnel wall and are being moved forward for gripping the tunnel wall at a new location, as described in the portion of the Winberg et al. patent quoted above.

Cass U.S. Pat. No. 3,861,748, issued Jan. 21, 1975, refers to the Robbins et al. U.S. Pat. No. 3,203,737 discussed above at column 1, lines 13 to 15, and states in column 2, beginning at line 47:

The mechanism which advances the boring machine forwardly in the tunnel includes a gripper assembly which is basically like the gripper assembly disclosed by the aforementioned U.S. Pat. No. 3,203,737.

The description then continues at column 2, line 51:

The gripper assembly 30 may comprise a gripper carrier 32 having a transverse passageway 34 formed therein in which two collinear gripper cylinders 36, 38 are housed. The cylinders 36, 38 comprise piston chambers which are rigidly connected together at their closed ends by upper and lower beam members 40, 42. A piston, one of which is designated 44, is located within each cylinder 36, 38. Piston rods 46, 48 extend outwardly from the pistons (44) and at their outer ends are connected to tunnel wall engaging gripper pads 50, 52. Note that there are *only two* cylinders 36 and 38 actuating *only two* piston rods 46 and 48, respectively.

Forward feeding of the cutterhead is accomplished by thrust rams or cylinders 72, 74 inclined forwardly from the gripper shoes 50 and 52, as shown in FIGS. 1, 7, 8 and 9 and described in column 3, beginning at line 23:

In the conventional manner, a pair of double-acting hydraulic thrust rams or cylinders 72, 74 are interconnected between the gripper pads 50, 52 of the gripper assembly 30 and forward portions of the frame 12, in the vicinity of the cutterhead support 14.

The operation of the machine is described at column 3, beginning at line 28:

FIG. 1 shows the boring machine at the start of an advance. The gripper cylinders 36, 38 are extended, forcing the gripper pads 50, 52 outwardly into gripping contact with opposite side wall portions of the tunnel. Hydraulic fluid is delivered into the thrust rams 72, 74 to cause their extension. As they extend they react rearwardly against the gripper assembly 30 and shove the frame 12, and the cutterhead 18 carried thereby, axially forwardly against the tunnel face. At the same time the motors 20 are operated to rotate the cutterhead 18. Cutterhead rotation and machine advance causes the disc cutter elements 26 to cut concentric kerfs in the tunnel face and to dislodge the material between the kerfs. The dislodged material is picked up by the scoops 28 and delivered into an overhead chute which deposits such material onto the conveyor housed within the beam 16. As the frame 12 moves forwardly the guide rail 62 moves forwardly through the guide bearings 58, 60 on the carrier 32. When the propulsion rams 72, 74 reach the ends of their stroke, the cylinders 36, 38 are retracted to withdraw the gripper pads 50, 52 from engagement with the tunnel wall. Then, the propulsion rams 72, 74 are retracted to in that manner pull the gripper assembly 70 forwardly along the rail 62. When the gripper assembly is at a forward position on the rail 62, the cylinders 36, 38 are again extended and the above described procedure is repeated.

It is evident that the cutterhead is not being moved forward when the cylinders 36 and 38 are retracted to withdraw the gripper pads 50, 52 from engagement with the tunnel wall and the propulsion rams 72, 74 are being retracted to pull the gripper assembly 70 forward to place the gripper pads 50, 52 at a new location. Again, therefore, the digging operation of this tunnel-boring machine is intermittent.

The title of Grandori U.S. Pat. No. 3,967,463, issued Jul. 6, 1976, is CONTINUOUS TUNNEL BORING MACHINE AND METHOD. This patent discusses the Robbins et al. U.S. Pat. No. 3,203,737 referred to above at column 1, lines 22 to 39, the portion from column 1, line 32 to line 39 , stating:

These cylinders react rearwardly against the gripper assembly and when they are extended serve to push the frame and the cutterhead carried thereby forwardly in the tunnel. At the end of the stroke the gripper assembly is retracted from the tunnel wall and is pulled forwardly by the cylinders into a new position. It is then extended laterally to take a new grip on the tunnel wall and the process is repeated.

The operation of the Grandori machine is described at column 5, beginning at line 5, as follows:

The gripper shoes 18 are extended to grip the tunnel wall to in that manner anchor the rear shield 12 in place in the tunnel. The forward thrust rams 52 are extended for the purpose of shoving the front shield 10 forwardly relative to the anchored rear shield 12. The cutterhead 60 is rotated to mine the tunnel face 70 as the shield 10 is being moved forwardly. Following full extension of the thrust rams 52 the gripper feet 18 are retracted and the thrust rams 52 are used for pulling the rear shield forwardly relative to the front shield 10. After the thrust rams 52 are fully retracted, and the rear shield 12 is in its new position forwardly of its old position, the gripper feet 18 are again extended and the above described operation is repeated.

Note that, after the thrust rams 52 are fully extended, the gripper feet are retracted and the thrust rams pull the rear shield forward. During that operation, it is evident that the boring procedure is interrupted so that the boring action of the machine is intermittent rather than being continuous.

The description continues at columns 5, line 25:

The thrust cylinders 52 are used for pushing the front shield 10 forwardly relative to the anchored rear shield 12 while the cutterhead 60 is driven for the purpose of mining the tunnel face 70. Following full advancement of the forward shield 10 the gripper feet 18 are retracted and the thrust cylinders 52 are used for pulling the rear shield 12 forwardly into a new position. The rear thrust rams 48 may have to be used to aid forward movement of shield 12. In other words, the rear thrust rams 48 may be extended rearwardly to react against the forward segments S of the tunnel lining TL. Following extension of the thrust rams 48 the gripper feet 18 are again extended for the purpose of anchoring the rear shield 12 in place of the tunnel. Then, the front shield 10 is again pushed forwardly relative to the rear shield 12 by use of the thrust rams 52.

Thus, it is clear that the cutting operation of the Grandori machine is intermittent.

In the machine of the Grandori patent, as in the machine of the Cass patent, there are only two gripper shoe or feet operating jacks 80 and 82, as stated at column 5, lines 50 to 52. As stated above, with reference to lines 9 to 11 of column 5, the cutterhead mines the tunnel face as the front shield 10 moves forward, but when the gripper shoes or feet are being moved forward for resetting the front shield 10 remains stationary so that the tunnel face is not being mined. As stated at column 6, beginning at line 42:

The pads 112 may also be extended for the purpose of gripping the tunnel wall for the purpose of helping to anchor the forward shield 10 in place while the rear shield 12 is being advanced forwardly.

The operation is further explained in column 7, beginning at line 16:

During tunneling the rear shield 12 is anchored in place by virtue of the fact that the gripper feet 18, 19 are extended outwardly into gripping contact with the tunnel wall.

The operation is further described beginning at column 7, line 59:

Referring to FIGS. 1 and 6–8, an advancement sequence of the machine will now be described. Let it be assumed that the machine is initially in the position shown by FIG. 1. The auxiliary thrust rams 48 are reacting against the forward end portion of the tunnel lining TL and the main thrust rams 52 are being operated for moving the forward shield 10 forwardly relative to the rear shield 12.

Continuing at column 8, line 3:

Following full extension of the main thrust rams 52, such main thrust rams are retracted and the rear shield 12 is advanced an amount equal to the stroke of the main thrust rams 52.

While the rear shield is being advanced by *contraction* of the rams 52, the front shield and the cutterhead being carried by it will remain stationary. The description then continues at column 8, line 11:

Following forward movement of the rear shield 12 the main thrust rams 52 may again be extended for the purpose of further advancing the front shield 10.

The double shield tunnel boring machine disclosed in Robbins et al. U.S. Pat. No. 4,420,188, issued Dec. 13, 1983, has aspects similar in appearance to the machine shown in Grandori U.S. Pat. No. 3,967,463. Compare, for example, FIGS. 1, 2, 3 and 4, of the Grandori patent with FIGS. 3, 4, 5 and 6 of Robbins et al. Pat. No. 4,420,188, respectively. Both of these patents are assigned to The Robbins Company, and application Ser. No. 481,292 filed Jun. 20, 1974, is mentioned in the Robbins et al. Pat. No. 4,420,188 at column 1, lines 11 and 12, and application Ser. No. 481,393, filed Jun. 20, 1974, is mentioned in the Grandori patent at column 1, lines 9 to 11. Robbins et al. Pat. No. 4,420,188 issued on the basis of a continuation-in-part application of Ser. No. 802,878, which was a continuation of Ser. No. 677,709, which was a continuation of Ser. No. 481,292, or perhaps Ser. No. 481,393.

Also, Robbins et al. Pat. No. 4,420,188 refers to the earlier Robbins et al. Pat. No. 3,203,737 discussed above at column 1, lines 24 to 41.

The machine of the Robbins et al. Pat. No. 4,420,188, like that of the Grandori patent, has a front shield 10 and an anchored rear shield 12, as shown in FIG. 1 and described in column 5, beginning at line 5:

The gripper shoes 18 are extended to grip the tunnel wall to in that manner anchor the rear shield 12 in place in the tunnel. The forward thrust rams 52 are extended for the purpose of shoving the front shield 10 forwardly relative to the anchored rear shield 12. The cutterhead 60 is rotated to mine the tunnel face 70 as the shield 10 is being moved forwardly. Following full extension of the thrust rams 52 the gripper feet 18 are retracted and the thrust rams 52 are used for pulling the rear shield forwardly relative to the front shield 10. After the thrust rams 52 are fully retracted, and the rear shield 12 is in its new position forwardly of its old position, the gripper feet 18 are again extended and the above described operation is repeated.

This statement is identical with the description in Grandori Pat. No. 3,967,463 at column 5, beginning at line 5. Again, therefore, it is evident that the cutterhead 10 is not being rotated to mine the tunnel face while the front shield 10 remains stationary and the rams 62 are being used for pulling the rear shield forwardly relative to the front shield 10 rather than the front shield being moved forward relative to the anchored rear shield. As in the other patents discussed, the machine of this patent performs an intermittent cutting operation. Such operation is further described in column 5, beginning at line 25:

The thrust cylinders 52 are used for pushing the front shield 10 forwardly relative to the anchored rear shield 12 while the cutterhead 60 is driven for the purpose of mining the tunnel face 70. Following full advancement of the forward shield 10 the gripper feet 18 are retracted and the thrust cylinders 52 are used for pulling the rear shield 12 forwardly into a new position . . . Following extension of the thrust rams 48 the gripper feet 128 are again extended for the purpose of anchoring the rear shield 12 in place in the tunnel. Then, the front shield 10 is again pushed forwardly relative to the rear shield 12 by use of the thrust rams 52.

The statement in this patent from column 4, line 27, to column 5, line 48, is the same as that in Grandori Pat. No. 3,967,463 from column 4, line 27, to column 5, line 49.

That the machine of the Robbins et al. Pat. No. 4,420,188 is stopped at times is further stated at column 5, beginning at line 47:

. . . forward advancement of the shield 12 is achieved by use of thrust rams 48 alone. Also, the tunnel lining is erected while the machine is stopped, following extension of rams 48 to move shield 12 forwardly and then retraction of the rams 48 to provide spaces for receiving new segments of the lining.

The gripper shoes are set by only one pair of hydraulic cylinders 94, 96, as stated beginning at column 5, line 65:

> Frame 84 also includes a pair of generally radial guideways 90 for a pair of side positioned, diametrically opposed gripper shoes 92, 93. The shoes 92, 93 are extended and retracted by a pair of upper and lower double-acting hydraulic cylinders 94, 96. The upper cylinder 94 is interconnected between mounting ears 98, 100 at the upper ends of the gripper shoes 92, 93. In similar fashion, the lower fluid cylinder 96 is interconnected between mounting ears 102, 104 at the lower ends of the shoes 92, 93.

The later Turner U.S. Pat. No. 4,548,443, issued Oct. 22, 1985, and also assigned to The Robbins Company, refers to the earlier Robbins et al. U.S. Pat. No. 4,420,188, discussed above, at column 1, line 27 to column 2, line 3. In this patent the shield 12 is the front shield (column 3, lines 40,41, 44, 45, 52 and 54, and column 4, lines 17, 23, 31, 40, 50, 56 and 62), whereas the rear shield is designated 14 (column 3, lines 40, 41, 46 and 52, and column 4, lines 20, 24, 32, 41, 52 and 57). The general arrangement and operation of the machine in Pat. No. 4,548,443 is, however, similar to the machine of U.S. Pat. No. 4,420,188 and U.S. Pat. No. 3,967,463. The principal difference is explained in column 1, beginning at line 27:

> The prior art includes the double shield tunnel boring machine disclosed in Robbins et al U.S. Pat. No. 4,420,188. The novel improvement in the present invention over that shown in the Robbins et al patent involves the use of a series of at least three pairs of hydraulic primary propel cylinders between the first and second shields, with each pair of primary propel cylinders being arranged in a V-shaped configuration having an included angle of about 15° to 60° in a plane generally parallel to the adjacent portions of the shields and with the line bisecting the included angle being substantially parallel to the longitudinal centerline of the machine. The pairs of primary propel cylinders rigidly tie the first and second shields together and perform the multiple functions of axial thrust (by simultaneous actuation), of transmitting reaction torque from the cutterhead support to the gripper system thereby countering the reverse rotary displacement of the cutterhead support caused by the rotary torque applied to the cutterhead, of steering (by selective actuation causing angular displacement of the first shield, the cutterhead support, and the cutterhead relative to the second shield which is held stationary by the gripper system), and of roll correction (by selective actuation causing clockwise or counterclockwise rotation of the first shield, the cutterhead support, and the cutterhead relative to the second shield which is held stationary by the gripper system). Thus, the novel primary propel cylinder pairs have a forward thrust function, a reaction torque function, a steering function, and a roll correction function. They provide at all times a rigid structure between the first and second shields, replacing the conventional axially disposed rearwardly extendable thrust cylinders (such as the thrust rams 52 in Robbins et al. U.S. Pat. No. 4,420,188), eliminating the need for separate reaction torque cylinders (such as the reaction torque cylinders 152 and 154 in the Robbins et al. patent), and also eliminating the need for precise control of the length of the reaction torque cylinders during the axial thrust stroke (such as in the Robbins et al. patent where, in order to maintain the first shield nonrotative with respect to the second shield, the extension of the torque cylinders 152 and 154 had to progressively change during the pivotal movement thereof caused by the forward axial movement of the first shield).

The boring operation effected by the machine of Pat. No. 4,548,443 is an intermittent operation as discussed in connection with the other patents. Advance of the cutterhead is accomplished by joint action of *all* of the propel cylinders, as stated at column 2, beginning at line 28:

> . . . controlling the pairs of primary propel cylinders to effect (1) axial forward thrust on the cutterhead by simultaneous actuation of all the primary propel cylinders . . .

and further beginning at line 44:

> As a second step, while rotating the cutterhead about its substantially horizontal axis, axially thrusting the cutterhead forward into the rock work face by simultaneously actuating all of the primary propel cylinders located rearwardly from the cutterhead . . .

With respect to the front and rear shields, it is stated at column 3, line 40 that:

> The rear shield assembly 14 telescopes into the front shield 12. In this respect, the present invention is similar to the machine disclosed in Robbins et al. U.S. Pat. No. 4,420,188, the disclosure of which is incorporated herein by reference. The front shield 12 comprises a rear section 16 which overlaps the forward portion 18 of rear shield 14.

The front shield 12 supports the cutterhead, as stated at column 4, line 11:

> The cutterhead support 32 (FIG. 3) and the front shield 12 support the cutterhead 25 . . . The front shield 12 forms the outer structure of the cutterhead support 32.

That the cutting operation of the machine of U.S. Pat. No. 4,548,443 is intermittent is indicated by the statement at column 4, beginning at line 17, that:

> The front shield 12 also houses the front stabilizer shoes 33 which extend during the boring operation to stabilize the cutterhead 24 and to lock the front shield 12 in the tunnel so that the rear shield 14 can be pulled forward during the recycle.

Since the front shield 12 is locked to the tunnel while the rear shield 14 is pulled forward, the cutting operation cannot continue because it is dependent on the front shield 12 being moved forward during the cutting operation.

The rear shield 14 is described beginning at column 3, line 57, as follows:

> The large area crab leg, window type gripper system 35 mounted on the circular rear shield/gripper support frame 23 provides low unit ground loading for reacting machine thrust, torque, and steering forces.

The rear shield is further described in column 5, beginning at line 14 as follows:

> The telescoping rear shield 14 consists of the shield structure, the crab leg window-type gripper system 35, a forward shield section 18 which telescopes into the front shield 18 which telescopes into the front shield 12, a tail section 20, and eight auxiliary thrust cylinders 38 (FIG. 4).

The three gripper shoes 57, 59, and 61 (FIG. 4) operate through windows in the rear shield 14. The right and left gripper shoes 59 and 61 are hinged on pins 63 and 65 in mounting brackets 78 and 80 which are secured to the lower portion of the rear shield/gripper support frame 23.

Since the rear shield 14 is a continuous annular structure in which the windows are formed, the gripper shoes 57, 59 and 61 can have no relative movement longitudinally of the machine.

The angled propel cylinders are connected to the support frame 23 which is a rigid part of the rear shield 14 and are not connected directly to the gripper shoes 57, 59 and 61, as stated at column 4, beginning at line 21:

The angled primary propel cylinders 28 are double acting hydraulic cylinders and are mounted in pairs between the front shield 12 and the rear shield 14. The propel cylinders 28 are mounted on the trunnion-type front mounting brackets 13 secured to the cutterhead support 32 and on the trunnion-type rear mounting brackets 15 secured to the rear shield/gripper support frame 23.

As shown in FIGS. 1 and 3, the primary propel cylinders 28 are arranged annularly in four equally spaced pairs located between the front shield 12 and the rear shield 14.

The description continues at column 4, line 39:

The pairs of propel cylinders 28 rigidly tie the first and second shields 12 and 14 together. Furthermore, the propel cylinders 28 perform the multiple functions of axial forward thrust when the propel cylinders 28 are all simultaneously actuated . . .

The propel cylinder arrangement is further described beginning at column 5, line 27:

The primary propel cylinders 28 (FIG. 3) are anchored to the front shield 12 and thrust against the rear shield/gripper support frame 23 into the gripper shoes 57, 59, and 61 into the tunnel wall.

Again, it is clear that the propel cylinders do not engage directly and are not connected directly to the gripper shoes 57, 59 and 61 but are connected to the support frame 23 which controls the position of the gripper shoes operating in windows in the rear shield, as stated above.

The operation of the machine is described in column 5, beginning at line 33:

The operating cycle of the tunnel boring machine 10 is next described. The machine 10 advances with an stroke of about 1.2 meters. This advance is provided by extension of the primary propel cylinders 28. Primary thrust reaction is provided by the gripper shoes 57, 59, and 61 which are expanded to contact the tunnel walls by the gripper cylinders 30 and 36 . . .

The cutterhead 24 then excavates about 1.2 meters of heading. When the advance is completed, the gripper shoes 57, 59, and 61 are retracted by retracting gripper cylinders 30 and 36. The rear shield assembly 14 is then moved forward by retraction of the primary propel cylinders 28 and extension of the rear auxiliary thrust cylinders 38 and the cycle i [s] then repeated. It is therefore evident that the machine disclosed in this patent also performs an intermittent boring operation.

Spencer U.S. Pat. No. Re. 31,511, reissued Jan. 31, 1984, and also assigned to The Robbins Company, discusses its advancing mechanism beginning at column 3, line 67:

The basic parts of the tunneling machine are a main frame which includes a cutterhead support 10 attached to a tubular shield 12 and a rearwardly projecting beam 14. A gripper assembly 16 is supported for relative sliding movement along a straight portion of the beam 14. Thrust rams 18, located on both sides of the machine, are interconnected between the cutterhead support 10 and the gripper assembly 16, generally in the manner disclosed by U.S. Pat. No. 3,203,737, granted Aug. 31, 1965 to Richard J. Robbins, Douglas F. Winberg and John Galgoczy, and by U.S. Pat. No. 3,861,748, granted Jan. 21, 1975, to David T. Cass.

As is well known in the tunneling machine art, the gripper assembly 16 is positioned forwardly on the beam 14. Its gripper shoes 17 are hydraulically moved outwardly into gripping contact with the side walls of the tunnel. Then, the thrust rams 18 are extended while the rotary cutterhead is being rotated by means of a plurality of drive motors 22. . . When the cylinders 18 reach the forward limits of travel the gripper pads 17 are retracted and the cylinders 18 are retracted for the purpose of drawing the gripper assembly forward into a new position. Then, the gripper pads 17 are again moved outwardly into contact with the tunnel wall and the boring procedure is repeated.

The machine of this patent also executes an intermittent boring operation which is interrupted while the gripper assembly carrying the gripper shoes or pads 17 is moved forward relative to the cutterhead into a new position.

A tunneling machine for which no patent application was filed was operated at Stillwater, MN., by Traylor Brothers, Inc., during the years 1981 and 1982. This machine had a central body rigidly connected to a support for a rotary boring head, the central portion of which body was hollow. A conveyor passed longitudinally of the machine through the body hollow for conveying muck from immediately behind the cutterhead to the rear of the machine. The body and cutterhead were advanced by longitudinally extending advancing jacks connected between the body and a set of anchor shoes arranged circumferentially around the hollow body. There were twelve of such shoes and twelve advancing jacks. The shoes were individually pressed against the tunnel wall by short, radially disposed, anchor-setting jacks pivotally connected both to the body and to the respective shoes. Reaction thrust was exerted on the body by rocking bases for the respective jacks bearing on the body as the cutterhead, body and jack bases were advanced relative to the anchor shoes.

With this construction, the setting cylinders of alternate shoes could be extended to set the shoes corresponding respectively to those jacks constituting a first set of shoes, whereas the setting jacks for the other alternate shoes, constituting a second set, would be sufficiently retracted to enable the jacks of such second set to slide along the tunnel wall. The advancing jacks connected between the shoes of the first set and the body of the machine would be extending to advance the machine body and cutterhead while the set of advancing jacks corresponding to the other set of anchor shoes would be contracting to slide the other set of anchoring shoes forward. Because the body was being moved forward relative to the unanchored set of anchor shoes, the setting jacks for the shoes of such set would be moving into forwardly and outwardly inclined positions relative to the forwardly moving body.

The difficulty with the Stillwater machine was the complexity of the apparatus caused by the large number of anchor shoes and advancing jacks and the fact that the rocking bearing of the bases of the shoe-setting jacks on the tubular machine body would cause localized stress pressures on the bases of such jacks. Also, because the setting jacks for gripping sets of shoes were required to be rocked relative to the body while the body was moving forward, the forward stroke for any shoe setting was quite short.

SUMMARY OF THE INVENTION

A principal object of the present invention is to provide tunneling machine mechanism enabling a tunnel machine to be advanced continuously for effecting a continuous tunnel boring operation by utilizing mechanism which is reliable, rugged and simple in operation.

More specifically, it is an object to provide a tunneling machine which can effect such operation which employs a simplified type of anchoring shoe arrangement that can be set in anchored condition to withstand the thrust reaction resulting from advancing the tunneling machine and then be released and moved forward while the reaction forces balancing the machine-advancing forces are transmitted to the tunnel wall through a different anchoring structure.

A specific object is to provide floating anchor shoe structure which is actuated by mechanism that does not interfere with the location of a conveyor extending through the body for removing muck or debris from the cutterhead.

The foregoing objects can be accomplished by anchoring structure including two pairs of anchoring shoes floating with respect to the tunneling machine body and arranged orthogonally which can be set against the tunnel wall by fluid pressure jacks extending diametrically of the body between the shoes of each pair. Such anchoring shoes are connected to the body only by bipods, the legs of which are connected to four thrust-receiving locations of the tunneling body arranged at approximately quadrant points. The legs of each bipod diverge forward from its apex connected to the circumferentially central point of an anchor shoe.

DETAILED DESCRIPTION

Figure 1:
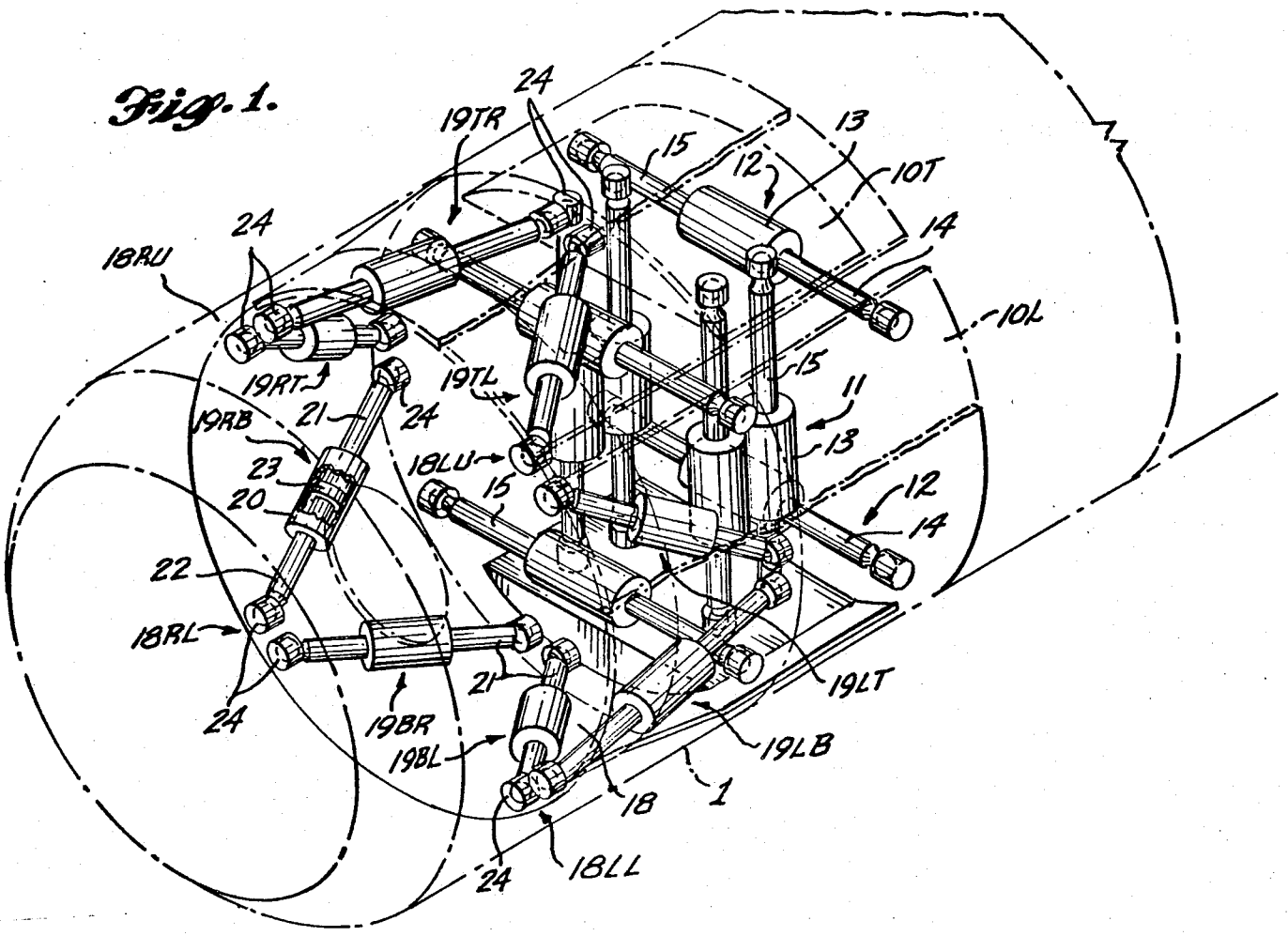
FIG. 1 is a diagrammatic top perspective of the forward portion of the tunneling machine illustrating the jack arrangement for setting the anchoring shoes and for advancing the tunneling machine body relative to the anchoring shoes.
Figure 15:
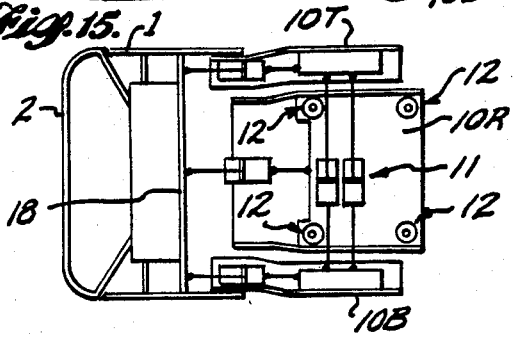
Figure 16:
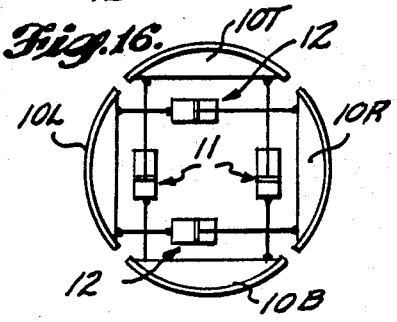

The general type of tunneling machine to which the present invention is applicable is shown in FIGS. 15 and 16 of U.S. Pat. No. 4,420,188 and FIG. 1 of U.S. Pat. No. 4,548,443 which have been discussed above. Consequently, aspects of the tunneling machine construction which do not have a bearing on the present invention will not be described in detail since such components are known generally in the art although their particular constructions may differ.

Figure 2:
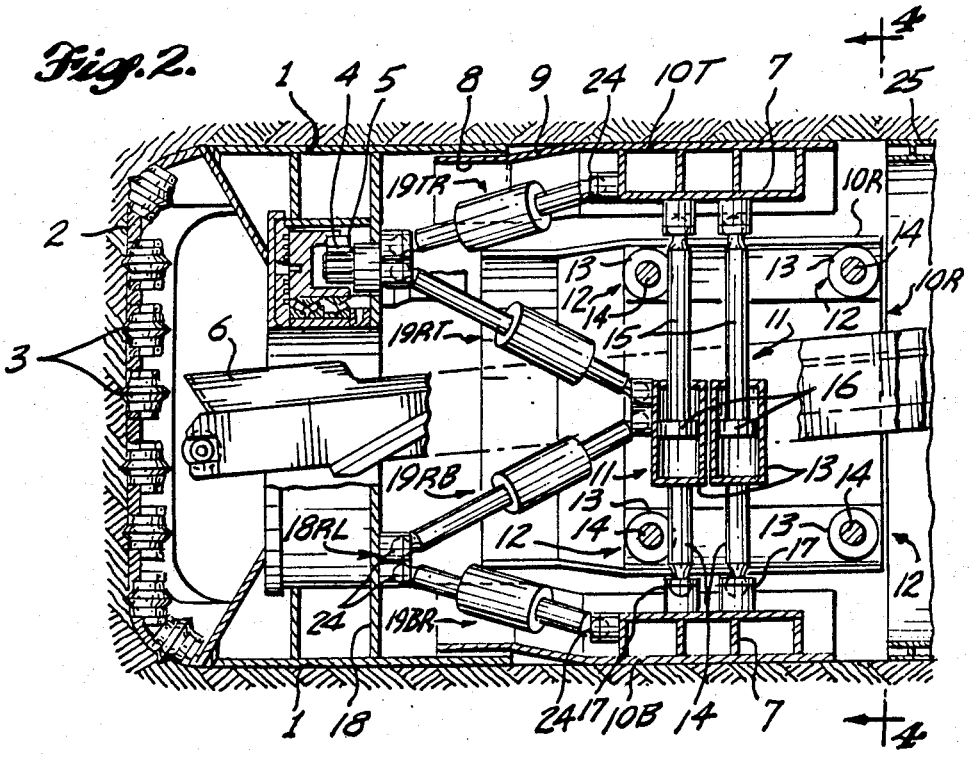
FIGS. 2 and 3 are longitudinal vertical sections through the forward portion of the tunneling machine, parts being broken away and parts being shown in different relative positions.
Figure 3:
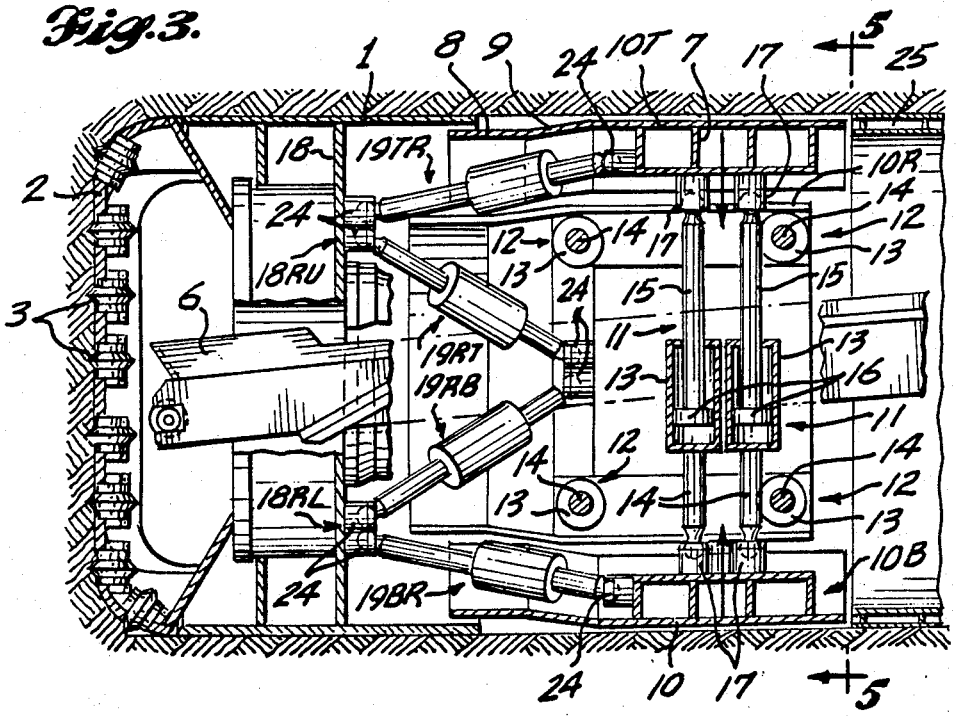

As shown in FIGS. 2 and 3, the tunneling machine includes a cylindrical body or casing 1 conforming to the size and shape of the tunnel being bored. The forward portion of this casing carries a rotary cutterhead 2 having nonpowered rotative cutters 3 that may be arranged in generally radial rows as shown in FIG. 2 of U.S. Pat. No. 4,548,443. The rotary cutterhead carries an internal ring gear 4 with which drive pinions 5 carried by the body 1 mesh. Rotation of the drive pinions will rotate the ring gear and cutterhead 2 so that the cutters 3 will chip away the face of the tunnel which they engage as the body 1 and cutterhead are advanced to the left, as seen in FIGS. 2, 3, 7, 9, 11, 13, and 15. The muck from the tunnel face is removed by a conveyor 6 shown in FIGS. 2 and 3 extending rearwardly through the tunneling machine body from the cutter head.

A key feature of the invention is the floating shoe character of the anchoring mechanism including two pairs of anchor shoes 7 floating relative to the tunneling machine body, each shoe having an arcuate circumferential extent of approximately a quadrant. Each shoe is composed of a reinforced strong cylindrical segment section having the same exterior arcuate curvature as the cylindrical body 1 and joined to a forwardly projecting arcuate shield 8 of smaller cylindrical arcuate shape by a transition section 9 having an exterior of conical arcuate shape. The exterior circumferential size of the cylindrically arcuate shield portion 8 is just slightly smaller than the internal cylindrically arcuate size of the trailing portion of the body 1 so that the shoe shield 8 underlaps the trailing portion of the body enabling such shoe shield and body to slide relatively longitudinally of the body.

The floating anchor shoes 7 are arranged in two pairs disposed in circumferentially orthogonal relationship with the anchor shoes of each pair disposed diametrically oppositely. Such shoes are disposed in generally circumferential registration. Steering control of the boring machine body 1 can be effected more easily if one pair of anchor shoes includes a top shoe 10T and a bottom shoe 10B while the other pair of shoes includes, looking forward, a left shoe 10L and a right shoe 10R.

The top and bottom shoes 10T and 10B are directly interconnected by two pairs of upright shoe-setting jacks 11 extending chordwise between them. The forward pair of upright shoe-setting jacks and the rearward pair of upright shoe-setting jacks 11 are arranged close together while also being disposed symmetrically lengthwise of the body 1 with respect to the opposite shoes. Similarly, the side shoes 10L and 10R are directly interconnected by two pairs of transverse shoe-setting jacks 12 extending chordwise between them. The upper and lower jacks of each pair of transverse jacks are arranged symmetrically lengthwise of the body 1 with respect to the side shoes, but the pairs of the transverse jacks are spaced apart longitudinally of the body much farther than such spacing of the pairs of upright jacks 11, with both upright jack pairs being located between the transverse jack pairs, as shown in FIGS. 2 and 3.

The spacing of the more widely spaced pairs of jacks, shown as being the transverse jacks, relative to the spacing of the more closely spaced pairs of jacks, shown as the upright jacks, governs the extent of advance of the tunneling machine for a particular setting of the anchoring jacks. Thus, with the pairs of jacks in the relative positions shown in FIG. 2, it is necessary for the horizontal jacks 12 to be relaxed so that the side shoes 10L and 10R can be slid forwardly relative to the top and bottom shoes 10T and 10B from the position shown in FIG. 2 to the position shown in FIG. 3 before the jacks 12 are set again so that the side shoes can serve to take the reaction of the machine-advancing thrust.

Each of the shoe-setting jacks includes a fluid pressure cylinder 13 to one end of which is rigidly attached a strut 14. A piston rod 15 extends into the opposite end of the cylinder and is connected to the piston 16 within the cylinder. The ends of the struts 14 and the piston rods 15 are connected to the shoes by universal joints 17.

Thrust forces are transmitted from the anchoring shoes 10T, 10B, 10L and 10R to a thrust bulkhead or ring 18 of the boring machine body 1 shown in FIGS. 2 and 3 which is disposed transversely of the length of such body. Such thrust is produced by bipods including legs diverging forwardly from the respective anchoring shoes to quadrant points on the body thrust ring 18. The legs of the bipods diverge forwardly from approximately the circumferentially central locations of the respective quadrant anchoring shoes. Thus the top bipod for the top shoe 10T is composed of a right leg 19TR inclined forwardly and downwardly to the right from the central portion of the top shoe to the right upper quadrant point 18RU on the thrust ring 18. Correspondingly, the left leg TL of the top bipod is inclined forwardly and downwardly to the left from a central location on the top shoe 10T to the left upper quadrant thrust point 18LU on the thrust ring 18.

The top tunneling machine advancing bipod works in conjunction with the bottom tunneling machine advancing bipod composed of the right leg 19BR inclined forwardly and upwardly to the right from the central portion of the bottom anchoring shoe 10B to the right lower quadrant point 18RL on the thrust ring 18 and the left bipod leg 19BL inclined forwardly and upwardly to the left from the central portion of the bottom anchoring shoe to the left lower quadrant thrust point 18LL on the thrust ring 18.

In sequence, alternate to operation of the top and bottom bipods, the left bipod and the right bipod cooperate with each other in advancing the body 1 by reacting from the left and right shoes 10L and 10R. The left bipod includes the leg 19LT inclined forwardly and upwardly to the right from the central portion of the left anchor shoe 10L to the left upper quadrant thrust point 18LU on the thrust ring 18 and the bottom leg 19LB inclined forwardly and downwardly to the right from the central portion of the left anchor shoe 10L to the left lower quadrant thrust point 18LL on the thrust ring 18. The right bipod includes the top leg 19RT inclined forwardly and upwardly to the left from the central portion of the right anchor shoe 10R to the right upper quadrant thrust point 18RU on the thrust ring 18 while the bottom leg 19RB of the right bipod is inclined forwardly and downwardly to the left from the central portion of the right anchor shoe 10R to the right lower thrust location 18RL on the thrust ring 18.

Each of the bipod legs is adjustable in effective length because it includes a fluid pressure jack cylinder 20, preferably hydraulic, a strut 21 fixed to one end of the cylinder and a piston rod 22 extending through the other end of the cylinder and connected to piston 23 in the cylinder. The end of the piston rod 22 remote from the cylinder 20 and the end of the strut 21 are connected to the thrust ring 18 and to an anchor shoe, respectively, by universal joint connectors 24.

It is emphasized that the top and bottom anchor shoes 10T and 10B and the side anchor shoes 10L and 10R are floating relative to the tunneling machine body 1 located forwardly of such anchor shoes and are connected to such body only by the bipods described above. The top and bottom anchor shoes 10T and 10B are connected directly to each other rearwardly of the body 1 by the two pairs of upright setting jacks 11, and the side anchor shoes 10R and 10L are connected directly to each other rearwardly of the body 1 by the two pairs of transverse setting jacks 12. Space opened behind the anchor shoes as they are moved forward is filled by stationary lining rings 25. The conveyor structure 6 extends longitudinally from the cutterhead 2 through the body 1 and the space between the anchoring shoes 10T, 10B, 10L and 10R and between the shoe-setting jacks of each pair as shown best in FIGS. 4, 5 and 6 to suitable supporting mechanism carried by the lining rings 25.

Each of the anchor shoes is connected to the body 1 only by a bipod, the legs of which are connected to substantially the circumferential center of each shoe, as shown in FIGS. 2 and 3. Each shoe is prevented from twisting or swiveling appreciably about such central connection, which would result in its arcuate axis departing from parallelism with the axis of the tunneling machine, because the cylindrically arcuate shoe exterior is always in engagement with the cylindrical tunnel wall shaped by the body 1, either being in pressure anchoring contact with the tunnel wall or in sliding or dragging contact with the tunnel wall.

In addition, the reduced leading cylindrically arcuate edge portion 8 of each shoe underlapping the outer wall of the cylindrical body 1 in close sliding relationship prevents the shoe from twisting appreciably relative to the tunneling machine body 1 despite the floating character of the anchor shoe connected at only one location by its bipod universal joints 24 to the tunneling machine body 1.

Figure 17:
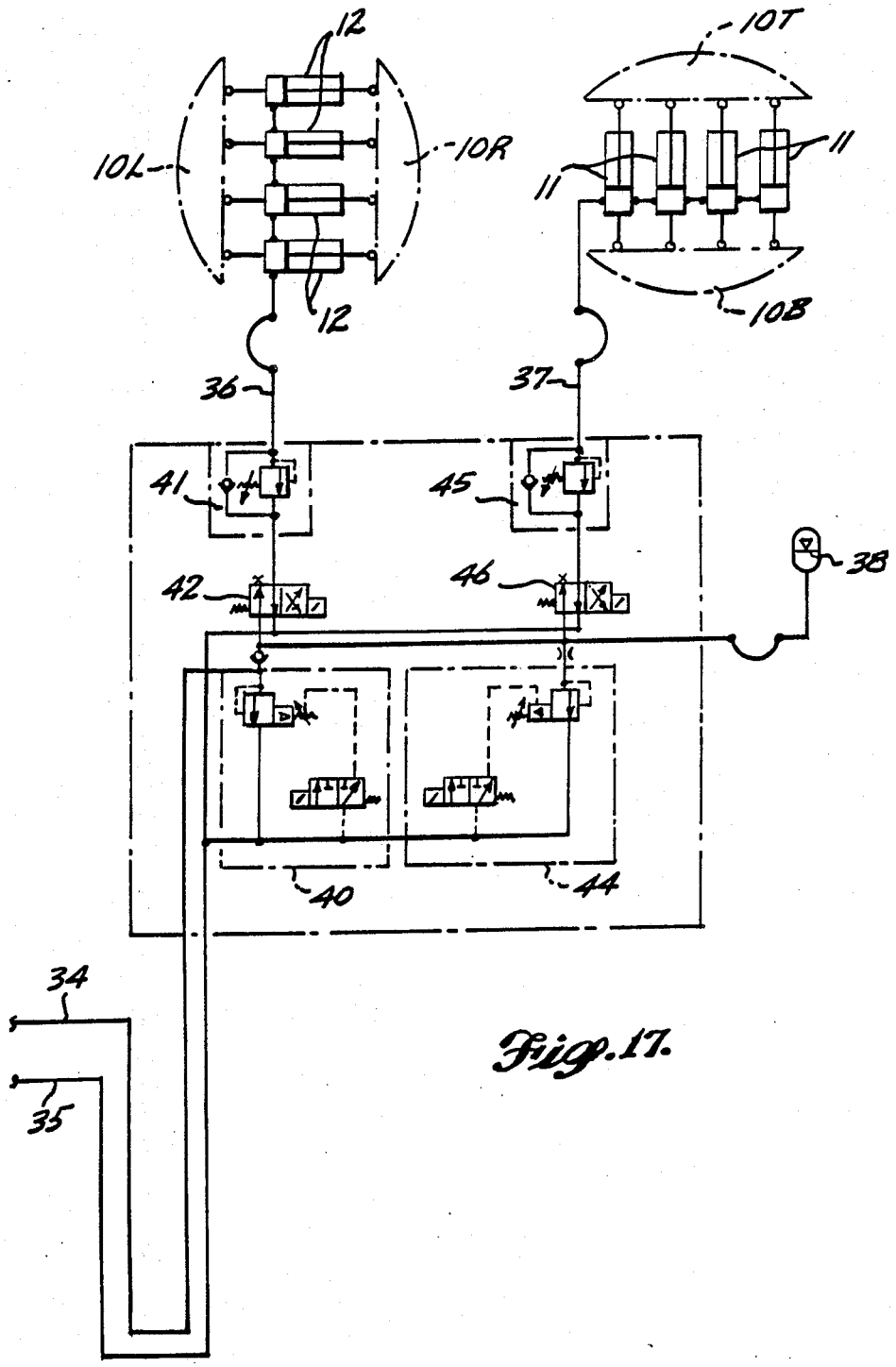
FIG. 17 is an electric and fluid piping circuit diagram illustrating the mechanism for setting the anchor shoes in anchored condition.

FIG. 17 shows a control circuit diagram for controlling supply of fluid under pressure, preferably hydraulic liquid, to the upright jacks 11 for setting or relaxing the top and bottom anchor shoes 10T and 10B, and for supplying fluid under pressure, preferably hydraulic liquid, to the transverse shoe-setting jacks 12 for setting or relaxing the left and right anchor shoes 10L and 10R.

Figure 18:
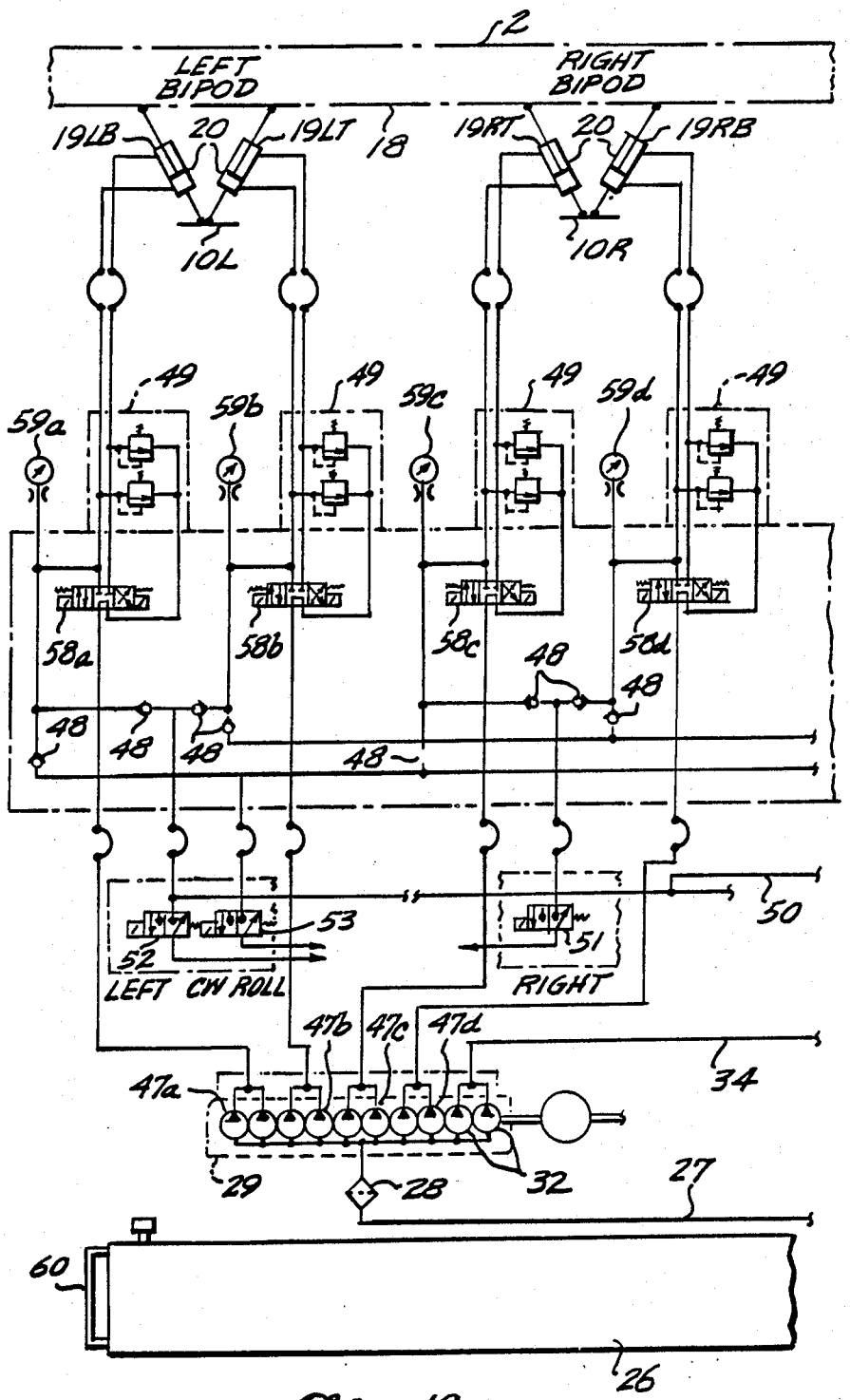
FIGS. 18 and 19 show an electric and fluid piping circuit diagram illustrating the mechanism for advancing the tunneling machine relative to the anchor shoes.
Figure 19:
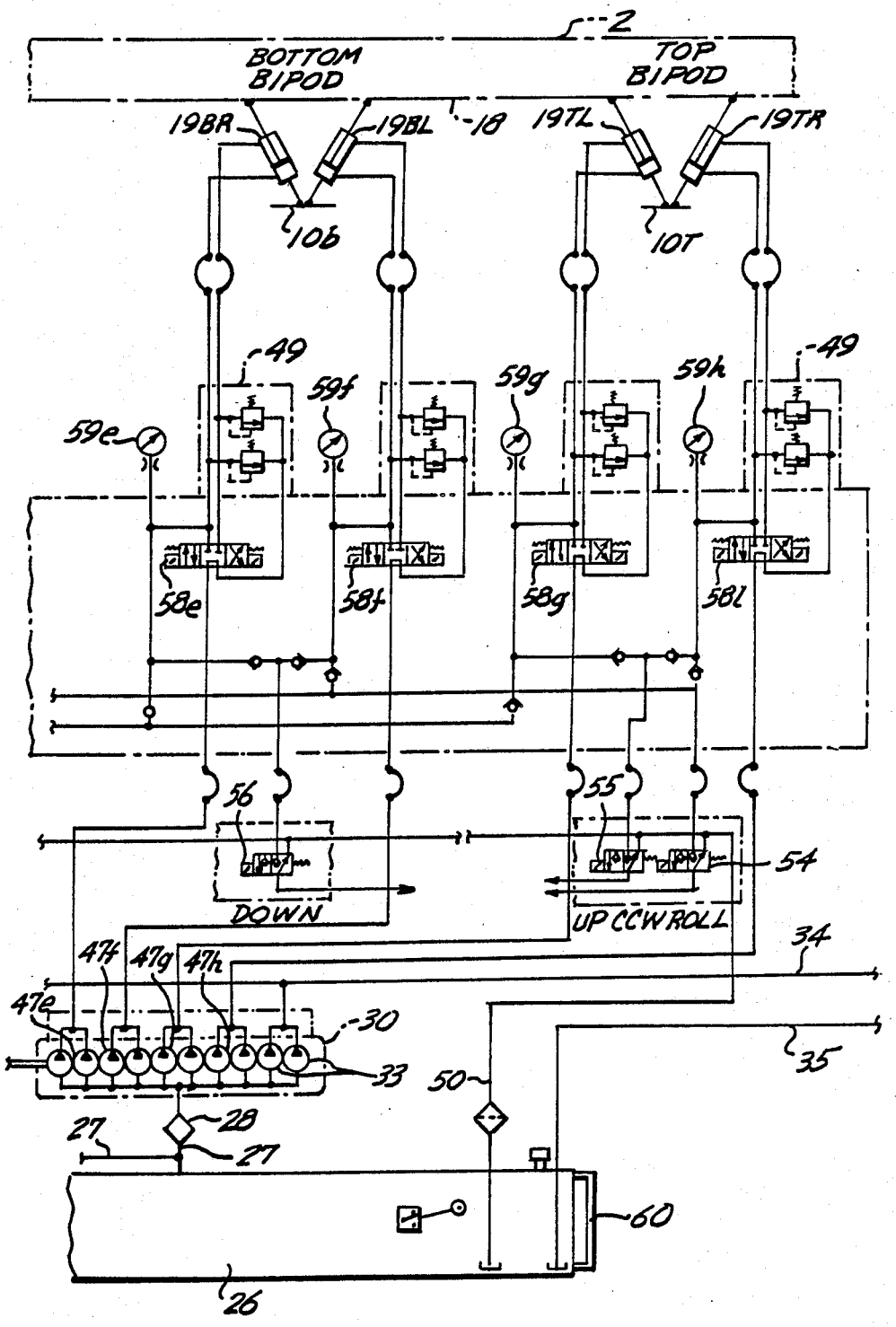

FIGS. 18 and 19 in combination show hydraulic circuit mechanism for supplying fluid under pressure, preferably hydraulic liquid, to the cylinders 20 of the jacks of the bipods that exert advancing thrust on the thrust ring 18 of the tunneling machine body 1, reaction from which thrust is exerted on at least one of the pairs of anchor shoes 10T and 10B or 10L and 10R. FIG. 19 shows the upper and lower bipods control mechanism circuit, and FIG. 18 shows the left and right bipods control mechanism circuit.

All of the hydraulic jacks are supplied with hydraulic liquid under pressure from a reservoir tank 26 from which liquid is pumped through supply conduits 27 having filters 28 to two banks 29 and 30 of hydraulic pumps. These pumps are arranged in pairs in each bank to provide adequate fluid supply capacity, the bank 29 including two shoe-setting pumps 32 and the bank 30 including two shoe-setting pumps 33, the output lines of which pumps are connected to the supply line 34 for connection to the shoe-setting jacks 11 and 12 shown in FIG. 17. Hydraulic liquid is returned from such shoe-setting jacks by the return conduit 35 to the reservoir tank 26.

One hydraulic liquid jack line 36 is connected to the jacks 12 for setting the left and right anchor shoes 10L and 10R. A second hydraulic liquid line 37 is connected to the jacks 11 for setting the top and bottom anchor shoes 10T and 10B. An accumulator 38 maintains substantially uniform fluid pressure in the supply to jack lines 36 and 37 without surges. When the pressure of fluid supplied by the supply line 34 exceeds a predetermined value, such as 5,000 psi, the unloader valve mechanism 40 comes into operation to bypass liquid from the supply conduit 34 back to the return conduit 35 while the desired anchoring pressure and/or dragging pressure is maintained in the jacks 12 for the side anchor shoes and in the jacks 11 for the top and bottom anchor shoes to enable the pumps 32 and 33 to continue to pump liquid even though the amount of liquid in the jacks remains substantially unchanged. Normally, accumulator 38 will maintain such pressure in the jack lines 36 and 37.

If the pressure in a line to set anchoring jacks drops below a predetermined value, such as 4,800 pounds, the replenishing apparatus 44 becomes effective for supplying liquid under pressure from the supply conduit 34 to the setting jack system until the pressure in that system maintained by the accumulator 38 exceeds such minimum value.

The control circuit for the horizontal hydraulic jacks 12 for setting the side anchor shoes 10L and 10R includes a reversing control valve mechanism 42 to alter the pressure in jack fluid line 36 connected to the jack cylinders between shoe-setting pressure and shoe-dragging pressure to enable the shoes to be repositioned. The control and operating mechanism for the upper and lower anchor shoes 10T and 10B is similar to that for controlling the side anchoring shoes 10L and 10R. In this instance, the circuit includes a reversing control valve mechanism 46 for controlling the pressure in jack fluid line 37 for causing the jacks 11 either to set the anchor shoes or to relax for enabling the anchor shoes to be repositioned.

Figure 7:
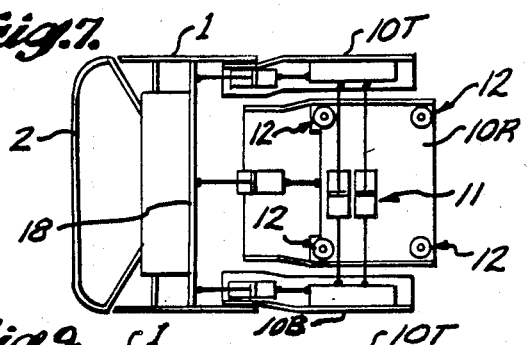
FIGS. 7, 9, 11, 13 and 15 are diagrammatic longitudinal sections through the forward portion of the tunneling machine illustrating parts in different operational relationships.
Figure 8:
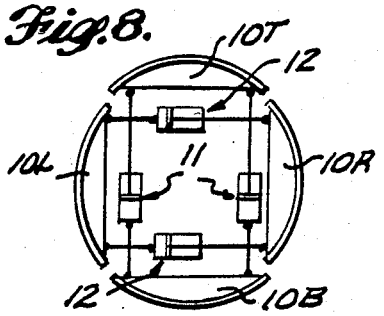
FIGS. 8, 10, 12, 14 and 16 are diagrammatic transverse vertical sections through the tunneling machine taken on line 4—4 of FIG. 2 showing components in positional relationships corresponding to those shown in FIGS. 7, 9, 11, 13 and 15, respectively.

The pressure in the cylinders of jacks 11 and 12 when the shoes are set may, for example, be 5,000 psi and the pressure in such jack cylinders when the jack pressure is relaxed for repositioning of the shoes may be 500 psi. The degree of shoe-dragging pressure in the cylinders of the jacks 12 is regulated by pressure-limiting valve 41 to such predetermined amount, such as 500 psi, for maintaining the shoes 10L and 10R in supporting contact with the tunnel walls as they are shifted lengthwise of the body relative to the set shoes 10T and 10B from one position, such as shown in FIGS. 7 and 8, to the position shown in FIGS. 9 and 10. Pressure limiting valve 45 controls the pressure in jack fluid line 37 when the control valve 46 is set for shoe-dragging operation.

When the side shoes 10L and 10R are held in set condition by the jacks 12, reversing control valves **58*a*, 58*b*, 58*c* and 58*d* can be set so that pump pairs 47*a*, 47*b*, 47*c* and 47*d* will supply equal quantities of hydraulic liquid under pressure to all the cylinders 20 of the left and right bipod legs 19LB, 19LT, 19RT and 19RB, respectively, as shown in FIG. 18, to advance the pressure ring 18, tunneling machine body 1 and cutterhead 2 relative to such side shoes. Undesired backflow of liquid under pressure in various parts of the system is prevented by check valves 48. The pressure in the jack lines is controlled by pressure relief valves 49 set to limit the pressure of fluid supplied to the bipod cylinders to a high pressure, such as 5,000 psi, when the valves 58*a*, 58*b*, 58*c* and 58*d* are set to supply equal amounts of fluid to the rear ends of the cylinders for extending the jacks to push the tunneling machine body 1 and cutterhead 2 forward relative to the set anchoring shoes 10L and 10R. When the control valves 58*a*, 58*b*, 58*c* and 58*d* are shifted to supply fluid in equal amounts to the forward ends of the jack cylinders 20 of side bipod legs 19LB, 19LT, 19RT and 19RB, for contraction of the jacks to slide the relaxed anchoring shoes forward relative to the set pair of anchoring shoes, the relief valves 49** maintain a lower pressure, such as 2,500 psi, in the jack cylinders.

The jacks 20 are double-acting jacks so that while hydraulic liquid under pressure is being supplied to one end of each jack cylinder liquid is being forced out of the other end of such cylinder through the return line 50 to the reservoir tank 26.

The tunneling machine body 1 can be steered by providing differential volumes of fluid to the cylinders of the side bipod jacks. A bleed valve 52 is provided to enable fluid to be bled from the fluid supplied to the jacks 19LB and 19LT of the left bipod, while full flow of fluid is provided equally to the jacks 19RT and 19RB of the right bipod, so that the higher pressure of the fluid in jacks 19RT and 19RB will turn the tunneling machine to the left. A second bleed valve 51 is provided to enable fluid to be bled from the fluid supplied to the jacks 19RT and 19RB of the right bipod while full fluid flow is provided equally to the jacks 19LB and 19LT of the left bipod so that the tunneling machine will be turned to the right. Alternative to bleeding fluid from the fluid supplied to the jacks of one bipod, all supply of fluid to the jacks of that bipod can simply be cut off by centering appropriate ones of valves **58*a*, 58*b*, 58*c* and 58*d*** to affect a comparatively sharp turn.

A bleed valve 53 can bleed fluid from the supply jacks 19LB of the left bipod and 19RT of the right bipod while full flow of fluid is provided to jacks 19LT of the left bipod and 19RB of the right bipod so that the tunneling machine body will be shifted in a clockwise direction looking forward, whereas if fluid is bled by bleed valve 54 from the supply of fluid to the jack cylinders of the legs 19LT and 19RB and full flow of fluid is supplied to the cylinders of jacks 19LB and 19RT, the body will be turned in a counterclockwise direction looking forward.

The control mechanism for the bipods connected to the top anchoring shoe 10T and the bottom anchoring shoe 10B shown in FIG. 19 is similar to the control mechanism for the side anchoring shoes shown in FIG. 18. In this instance, the pump pairs **47*e*, 47*f*, 47*g* and 47*h*** are again connected to the bipod jack cylinders through control valves 58*e*, 58*f*, 58*g* and 58*h*. As in the control circuits described previously, a higher fluid pressure, such as 5,000 psi, is provided in the cylinders 20 when the shoes 10L and 10R are set in anchoring condition for extending the jacks to advance the tunneling machine body and cutterhead 2 and relief valves 49 enable fluid to be bled from the jack supply lines so that a lower pressure, for example, of 2,500 psi, is supplied to the jacks when they are being contracted to shift the anchoring shoes 10L and 10R forward relative to the set side anchoring shoes 10B and 10T.

Roll of the tunneling machine can be controlled by the top and bottom shoe bipods by bleed valves 53 and 54 in the manner previously described with respect to the side bipods. If the top and bottom jacks are set, valve 53 will bleed fluid from the fluid supply to jacks 19BR of the bottom bipod and 19TL of the top bipod so that higher pressure in jacks 19BL of the bottom bipod and 19TR of the top bipod will roll the tunneling machine body clockwise. Bleed of fluid can be effected by valve 54 from the fluid supplied to jacks 19TR of the top bipod and 19BL of the bottom bipod while full supply of fluid is supplied to jacks 19BR of the bottom bipod and 19TL of the top bipod to roll the tunneling machine body counterclockwise.

Control 55 can be actuated to bleed fluid from the jack lines of the jacks in legs 19TL and 19TR of the top bipod so as to reduce the fluid pressure in them below the pressure in the jacks of legs 19BL and 19BR of the bottom bipod to cause the tunneling machine to tilt upward for reducing the depth of the tunnel and control 56 can be utilized to bleed fluid from the jack lines of the jacks of legs 19BL and 19BR of the bottom bipod so as to reduce the fluid pressure in them below the fluid pressure in the jacks of legs 19TL and 19TR of the top bipod to cause the tunneling machine to tilt downward for increasing the depth of the tunnel.

The gauges 59*a*, 59*b*, 59*c*, 59*d*, 59*e*, 59*f*, 59*g* and 59*h* indicate the pressures in the various jacks for the information of the operator.

Sight glasses 60 indicate the level of the hydraulic liquid in the reservoir tank 26.

In normal operation, reaction from the thrust exerted by the bipods to advance the tunneling body and cutterhead is exerted alternately on the top and bottom anchor shoes 10T and 10B and on the left and right anchor shoes 10L and 10R except during transfer of the anchoring action from one pair of anchor shoes to the other pair of anchor shoes. FIGS. 9 to 16, inclusive, illustrate sequential operation of the anchoring shoes during advancing of the tunneling machine body.

Figure 10:
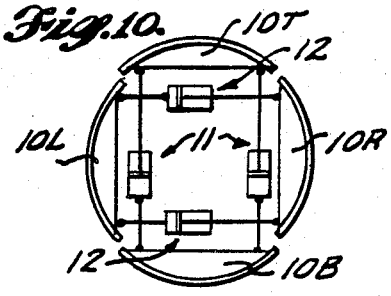
Figure 11:
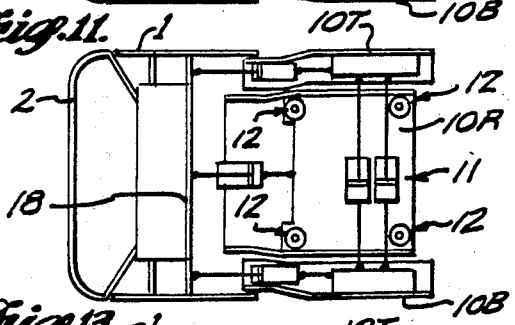
Figure 12:
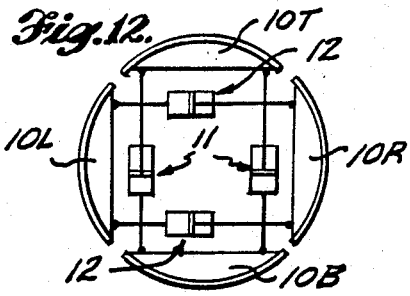

The position of parts shown in FIG. 2 corresponds to the position of parts shown in FIGS. 7, 8, 15 and 16 and the position of parts shown in FIG. 3 corresponds to the position of parts shown in FIGS. 11 and 12. Also, the position of parts shown in FIG. 4 corresponds to the position of parts shown in FIGS. 12 and 16, the position of parts shown in FIG. 5 corresponds to the position of parts shown in FIG. 14 and the position of parts shown in FIG. 6 corresponds to the position of parts shown in FIGS. 8 and 10.

The important feature of the anchor shoe structure of the present invention and its controlling mechanism is that the tunneling machine body 1 and its cutterhead 2 can be advanced continuously by application of an advancing thrust force that reacts first from one pair of floating opposite anchor shoes and then from the other pair of floating opposite anchor shoes. Although the machine can be operated so that the reaction of the advancing force is applied to all four anchoring shoes, such application ordinarily occurs only briefly during transition of the application of the reaction force from one pair of anchoring shoes to the other.

In the operation illustrated by FIGS. 7 and 8, the top and bottom anchoring shoes 10T and 10B have just been set by extension of the upright jacks 11, the side anchoring shoes 10L and 10R have just been released by relaxation of pressure in the transverse jacks 12 and the tunneling machine body 1 is being advanced relative to upper and lower anchoring shoes 10T and 10B by thrust of the top and bottom bipods reacting from the set top and bottom anchoring shoes. Immediately following such operation, the side bipods are contracted to slide the side anchoring shoes 10L and 10R along the tunnel wall forward from the position shown in FIG. 7 relative to the top and bottom anchoring shoes to the positions shown in FIG. 9. During such movement it will be seen that the side anchoring shoes move from a position in which their leading ends are behind the leading ends of the top and bottom anchoring shoes into a position in which the leading ends of the side anchoring shoes are ahead of the leading ends of the top and bottom anchoring shoes.

Figure 9:
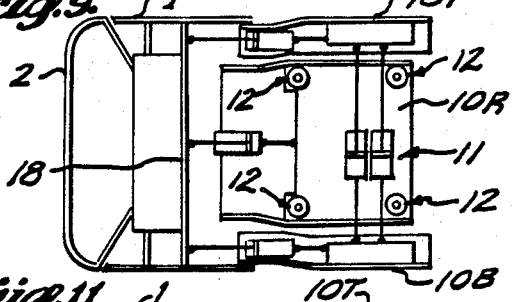

The side anchoring shoes 10L and 10R are maintained with their leading ends thus advanced beyond the leading ends of the top and bottom anchoring shoes 10T and 10B until the tunneling machine body has been moved forward relative to the anchoring shoes to the position of FIG. 9 in which the upper and lower bipods have nearly reached their maximum extension stroke. At this point the transverse shoe-setting jacks 12 are extended from the condition shown in FIG. 10 to the condition shown in FIG. 12 setting the side anchoring shoes 10L and 10R against the tunnel wall. Simultaneously, or immediately preceding such setting, the side bipods are extended in conjunction with the extension of the top and bottom bipods to continue the advance of the tunneling machine body without interruption. Immediately thereafter, the fluid pressure in upright anchor shoe-setting jacks 12 is relaxed to release the top shoe 10T and the bottom shoe 10B from the positions shown in FIG. 12 to the positions shown in FIG. 14. Thereupon, the top and bottom bipods can be contracted to slide the top and bottom anchoring shoes 10T and 10B relative to the set side anchoring shoes so that the leading ends of the top and bottom anchoring shoes move from the positions shown in FIG. 11 past the leading ends of the side anchoring shoes to the positions shown in FIG. 13.

Figure 13:
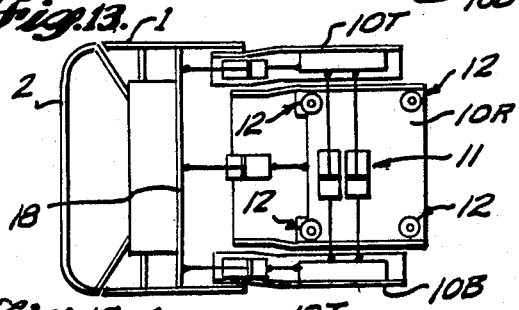
Figure 14:
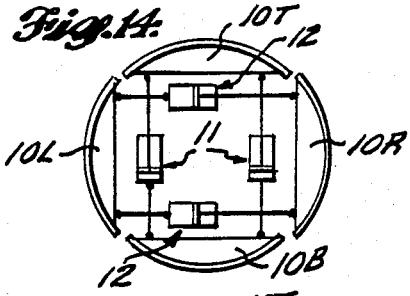

As the advance of the tunneling machine body continues by extending the side bipods substantially to the position of FIG. 13, the upright setting jacks 11 will be extended to set the top and bottom anchoring shoes 10T and 10B against the tunnel wall as shown in FIG. 16, at which time forward movement of the tunneling machine body is accomplished by extending the upper and lower bipods with the force reacting against the top and bottom anchoring shoes 10T and 10B while the pressure in the transverse setting jacks 12 is relaxed sufficiently to release the side anchoring shoes 10L and 10R to the positions indicated in FIG. 8. Promptly thereafter, the side bipods can be contracted to slide the side anchoring shoes again from the positions shown in FIGS. 15 and 7 relative to the top and bottom anchoring shoes 10T and 10B to the positions shown in FIG. 9 to complete an operating cycle throughout which the body 1 and cutterhead 2 have been moving continuously forward.

In the tunneling machine advancing operation, the fluid pressure in the shoe-setting jacks is relaxed only to the extent necessary to enable the anchoring shoes to slide in supporting contact with the tunnel wall. The shoes are never withdrawn from contact with the wall. FIGS. 3, 5, 6, 8, 10 and 14 show the anchoring shoes which are not in anchoring condition as being displaced inward from the tunnel wall for purposes of illustration, but actually, in their released condition the anchoring shoes are never withdrawn out of contact with the tunnel wall. The pressure of the shoes against the tunnel wall is simply relaxed sufficiently to enable the shoes to be slid forward relative to the set anchoring shoes while such shoes continue to press against and support or back the material of the tunnel wall.

Figure 4:
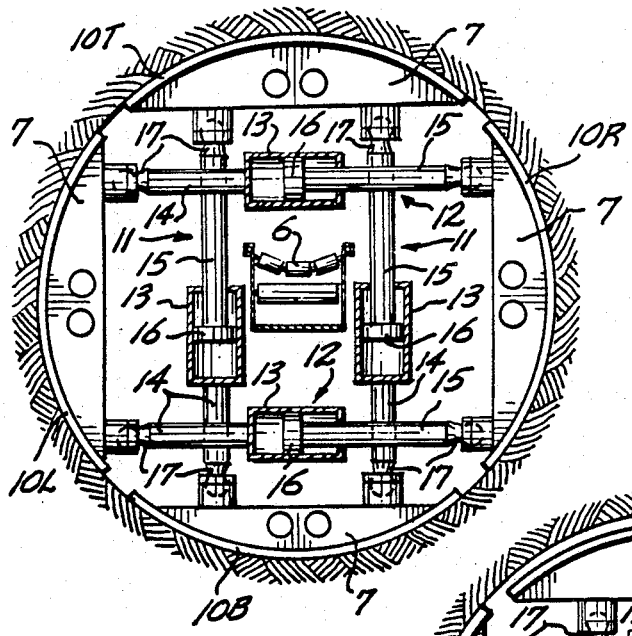
FIG. 4 is a transverse vertical section taken on line 4—4 of FIG. 2.
Figure 5:
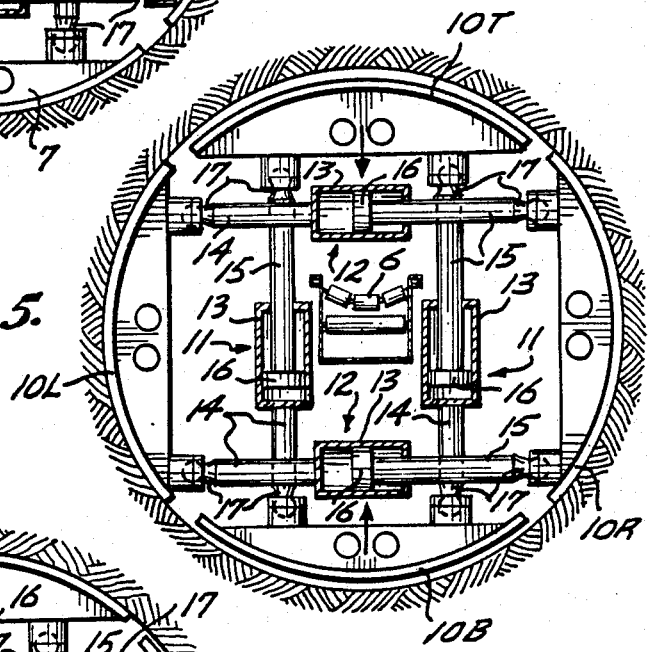
FIG. 5 is a corresponding vertical section taken on line 5—5 of FIG. 3
Figure 6:
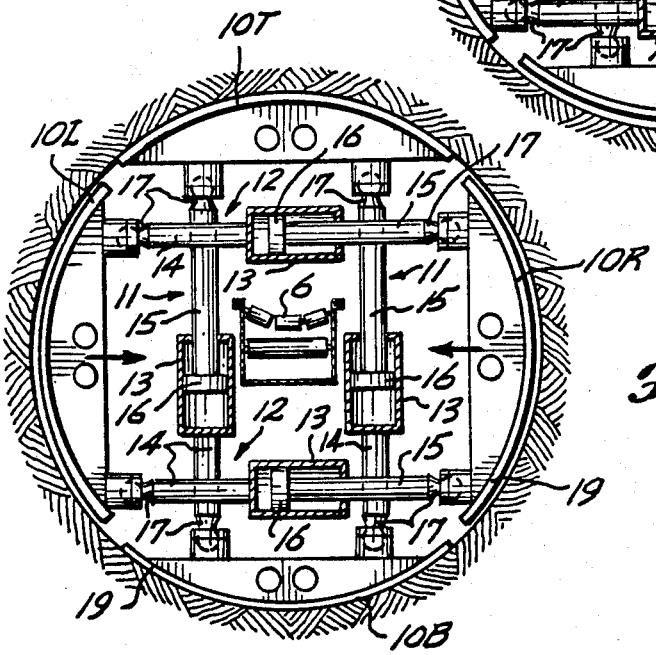
FIG. 6 is a further vertical section corresponding to FIGS. 4 and 5 but showing parts in a different operational relationship.

As indicated in FIGS. 4, 5 and 6, the pairs of setting jacks are located outward from the center of the tunneling machine sufficiently to accommodate the muck-removing conveyor 6 in the rectangular space between the shoe-setting jacks of each pair inclined rearwardly upwardly from a position adjacent to the cutting head 2. Also the pairs of upright shoe-setting jacks 11 are located close together longitudinally of the tunneling machine and the pairs of transverse shoe-setting jacks 12 are spaced apart longitudinally of the machine substantially as far as practicable so as to maximize the distance that the tunneling machine body can be moved forward without transferring the anchoring function of one pair of anchoring shoes to the other pair of anchoring shoes.

The tunneling machine can be steered either upward or downward by supplying different amounts of fluid under pressure to the top and bottom bipods, respectively, when the top and bottom anchoring shoes 10T and 10B are set in anchored condition as explained above. Also, the tunneling machine can be veered to the left or to the right by supplying different amounts of fluid under pressure to the left and to the right bipods, respectively, when the side-anchoring shoes 10L and 10R are in set anchored condition.

Whether the top and bottom bipods or the side bipods are exerting the advancing thrust on the thrust ring 18, such advancing force in either instance will be exerted on approximately the same quadrant points 18RU, 18RL, 18LU and 18LL of the thrust ring 18.

I claim:

1. A tunnel boring machine comprising a body having a front end, a rotary cutterhead of substantially the same frontal size as said body front end, rotatively mounted on said front end of said body and having cutters distributed circumferentially around said rotary cutterhead, a pair of anchor shoes floating relative to said body, the anchor shoes of said pair being disposed diametrically oppositely in generally circumferential registration, shoe-setting jack means floating relative to said body and engaged directly between the opposite anchor shoes of said anchor shoe pair for spreading the anchor shoes of said pair to set them against the tunnel wall in machine-anchoring position, said body including thrust-receiving means, and body-advancing jack means directly engaged between said thrust-receiving means and both shoes of said pair of floating anchor shoes for advancing said body relative to said floating anchor shoes and to said floating shoe-setting jack means.

2. The boring machine defined in claim 1, in which the body-advancing jack means are connected to the anchor shoes and constitute the sole means connecting the anchor shoes to the body.

3. The boring machine defined in claim 1, in which the body-advancing jack means are connected to the thrust-receiving means and to the anchor shoes and constitute the sole means connecting the anchor shoes to the body.

4. The boring machine defined in claim 1, in which the thrust-receiving means includes thrust-receiving components spaced circumferentially of the body at approximately quadrant points and the body-advancing jack means includes two body-advancing fluid-pressure jack bipods, each anchor shoe is circumferentially arcuate and the apexes of said bipods being connected directly to substantially the circumferentially central portions of the anchor shoes, respectively, and the legs of each bipod being connected, respectively, to thrust-receiving components spaced circumferentially of the body and the bipods constituting the sole connection between the anchor shoes and the body.

5. The boring machine defined in claim 4, in which the body includes a circumferential shield and each anchor shoe carries a shield independent of the shield of the other anchor shoe and having a portion disposed in closely underlapping relationship to a portion of said body circumferential shield for limiting twisting or swiveling of the respective anchor shoes about the bipod connection relative to the body circumferential shield.

6. The boring machine defined in claim 4, one leg of each bipod, which legs are corresponding, producing thrust which is greater than the thrust produced by the other corresponding legs of the bipods.

7. The boring machine defined in claim 1, in which the shoe-setting jack means include jacks extending chordwise of the body, two pairs of jacks being engaged between the opposite anchor shoes of the anchor shoe pair and arranged symmetrically relative to the anchor shoes of such pair, and the pairs of jacks connecting the anchor shoes being spaced apart longitudinally of the body.

8. A quadrishoe tunnel boring machine comprising a body having a front end, a rotary cutterhead rotatively mounted on the front end of said body, two pairs of anchor shoes floating relative to said body, means mounting the anchor shoes of said two anchor shoe pairs in generally circumferential registration with the anchor shoes of each anchor shoe pair disposed diametrically oppositely and enabling the leading portions of the anchor shoes of each anchor shoe pair to pass the leading portions of the anchor shoes of the other anchor shoe pair longitudinally of said body, shoe-setting jack means for spreading the anchor shoes of each anchor shoe pair to set them against the tunnel wall in machine-anchoring position independently of the anchor shoes of the other anchor shoe pair, said body including thrust-receiving means, and body-advancing jack means engaged directly between said thrust-receiving means and both anchor shoes of one anchor shoe pair for advancing said body relative to such one pair of anchor shoes irrespective of the relationship between said body and the other pair of anchor shoes.

9. The boring machine defined in claim 8, in which the body-advancing jack means are connected to both pairs of anchor shoes and constitute the sole means connecting the anchor shoes to the body.

10. The boring machine defined in claim 8, in which the body-advancing jack means are connected to the thrust-receiving means and to both pairs of anchor shoes and constitute the sole means connecting the anchor shoes to the body.

11. The boring machine defined in claim 8, in which the shoe-setting jack means include jacks extending chordwise of the body, two pairs of said jacks being engaged directly between the opposite anchor shoes of a first anchor shoe pair, the jacks of each of said pairs being parallel and spaced transversely of the body, said pairs of shoe-setting jacks being spaced apart longitudinally of the body, the shoe-setting jack means further including jacks engaged directly between the anchor shoes of the other pair of anchor shoes and located between the jack pairs engaged directly between the opposite anchor shoes of the first anchor shoe pair, the jacks of each of said pairs being arranged symmetrically with respect to the opposite anchor shoes of the anchor shoe pair between which they are engaged.

12. The boring machine defined in claim 8, in which the thrust-receiving means includes four thrust-receiving components spaced circumferentially of the body at approximately quadrant points, and the body-advancing jack means includes four body-advancing jack bipods, the legs of each bipod diverging forward from approximately the circumferentially central point of an anchor shoe to two thrust-receiving components.

13. The boring machine defined in claim 12, in which the body includes a circumferential shield, and each anchor shoe carries an arcuate shield of approximately a quadrant in extent independently of the shields of the other anchor shoes and a portion of each shoe arcuate shield being disposed in closely underlapping relationship to a portion of said body circumferential shield for limiting twisting movement of each anchor shoe relative to said body circumferential shield about a location at which its bipod is connected to such shoe.

14. In a tunnel boring machine having a body, a first pair of anchor shoes floating relative to the body disposed diametrically oppositely and in generally circumferential registration, two pairs of shoe-setting jacks extending chordwise of the body and engaged between the opposite anchor shoes of said first anchor shoe pair for spreading the anchor shoes of such pair to set them against the tunnel wall in machine-anchoring position, the jacks of each pair being parallel and spaced apart transversely of the body and said pairs of shoe-setting jacks being spaced apart longitudinally of the body, a second pair of diametrically opposite anchor shoes disposed in circumferentially orthogonal relationship with respect to the anchor shoes of said first anchor shoe pair, and shoe-setting jack means extending chordwise of the body and engaged between the opposite anchor shoes of said second anchor shoe pair for spreading the anchor shoes of said second anchor shoe pair to set them against the tunnel wall in machine-anchoring position, the entire shoe-setting jack means engaged between the opposite anchor shoes of said second anchor shoe pair being located longitudinally of the body between said two pairs of jacks engaged between said anchor shoes of said first anchor shoe pair.

15. The tunnel boring machine defined in claim 14, in which the shoe-setting jack means for the second pair of anchor shoes includes two pairs of shoe-setting jacks extending chordwise of the body and engaged between the opposite anchor shoes of the second anchor shoe pair, the jacks of the second pair of shoe-setting jacks being parallel and spaced apart transversely of the body and the pairs of such shoe-setting jacks being spaced apart longitudinally of the body.

16. A process for advancing continuously a tunnel boring machine to effect a continuous boring operation, which comprises setting against the tunnel wall in anchored condition a first pair of diametrically opposite anchor shoes, advancing the boring machine body and cutterhead carried thereby by extending first advancing jack means reacting directly from both shoes of the set first pair of anchor shoes, during such advancing maintaining in unset condition a second pair of diametrically opposite anchor shoes disposed orthogonally relative to the set first pair of anchor shoes, advancing the unset second pair of anchor shoes from a position in which their leading portions are rearwardly of the leading portions of the set first pair of anchor shoes to a position in which the leading portions of the second pair of anchor shoes are ahead of the leading portions of the set first pair of anchor shoes, setting the anchor shoes of such second pair of anchor shoes against the tunnel wall in anchored condition, continuing to advance the boring machine body and cutterhead carried thereby by extending second advancing jack means reacting from both shoes of the set second pair of anchor shoes, unsetting the first pair of anchor shoes from set anchored condition, and contracting the first advancing jack means to advance the unset first pair of anchor shoes.

17. The process defined in claim 16, including, while the advance of the boring machine body and cutterhead is continued by extending the second advancing jack means, contracting the first advancing jack means and thereby advancing the first pair of anchor shoes from a position in which their leading portions are rearwardly of the leading portions of the set second pair of anchor shoes to a position in which the leading portions of the first pair of anchor shoes are ahead of the leading portions of the set second pair of anchor shoes.

18. A process for advancing continuously a tunnel boring machine to effect a continuous boring operation, which comprises setting against the tunnel wall in anchored condition a first pair of diametrically opposite anchor shoes, advancing the boring machine body and cutterhead carried thereby by extending advancing jack means reacting directly from the set first pair of anchor shoes, during such advancing maintaining in unset condition a second pair of diametrically opposite anchor shoes disposed orthogonally relative to the set first pair of anchor shoes while maintaining the anchor shoes of the second pair of anchor shoes in material-supporting engagement with the tunnel wall, advancing the unset second pair of anchor shoes from a position in which their leading portions are rearwardly of the leading portions of the set first pair of anchor shoes to a position in which the leading portions of the second pair of anchor shoes are ahead of the leading portions of the set first pair of anchor shoes while still maintaining the anchor shoes of the second pair of anchor shoes in material-supporting engagement with the tunnel wall, and again setting the anchor shoes of such second pair of anchor shoes against the tunnel wall in anchored condition.

19. A process for advancing a tunnel boring machine to effect a boring operation, which comprises setting against the tunnel wall in anchored condition a pair of diametrically opposite anchor shoes, advancing the boring machine body and cutterhead carried thereby by extending advancing jack means reacting directly from the set pair of anchor shoes, following such advancing relaxing from set anchored condition such pair of diametrically opposite anchor shoes while maintaining such anchor shoes in pressing material-supporting engagement with the tunnel wall, advancing the relaxed pair of anchor shoes by sliding them along the tunnel wall while still maintaining such shoes in pressing material-supporting engagement with the tunnel wall, and again setting such anchor shoes against the tunnel wall in anchored condition.

20. In a tunnel boring machine, a body, a pair of anchor shoes floating relative to said body, the anchor shoes of said anchor shoe pair being disposed diametrically oppositely in generally circumferential registration and being circumferentially arcuate, said body including a circumferential shield, and each anchor shoe carrying a shield independent of the shield of the other shoe and having a portion disposed in closely underlapping relationship to a portion of said body circumferential shield for limiting twisting or swiveling of said respective anchor shoes relative to said body circumferential shield.

* * * * *